US006892416B2

(12) United States Patent
Lee et al.

(10) Patent No.: US 6,892,416 B2
(45) Date of Patent: May 17, 2005

(54) BABY BOTTLE BRUSH

(75) Inventors: Sang Woong Lee, 375-3 Yongjeong-Ri, Pungse-Myun, Cheonan-Si, Chungcheongnam-Do, 330-919 (KR); Dong Hean Lee, Cheonan-Si (KR)

(73) Assignee: Sang Woong Lee, Cheonan-Si (KR)

( * ) Notice: Subject to any disclaimer, the term of this patent is extended or adjusted under 35 U.S.C. 154(b) by 219 days.

(21) Appl. No.: 10/060,024

(22) Filed: Jan. 31, 2002

(65) Prior Publication Data

US 2002/0112301 A1 Aug. 22, 2002

(30) Foreign Application Priority Data

Dec. 12, 2000 (KR) ..... 2000-34738 U
Dec. 26, 2000 (KR) ..... 2000-36350 U
Jun. 22, 2001 (WO) ..... PCT/KR01/01068

(51) Int. Cl.[7] ..... B08B 9/087
(52) U.S. Cl. ..... 15/164; 15/65; 15/59
(58) Field of Search ..... 15/164, 165, 160, 15/211, 212, 65, 67, 59, 71, 201, 203, 213

(56) References Cited

U.S. PATENT DOCUMENTS 444,710 A * 1/1891 McPherson ..... 15/26
982,566 A * 1/1911 Berg ..... 15/65
1,622,900 A * 3/1927 Becker ..... 15/165
2,265,192 A * 12/1941 Alphonce Piron Francis . 15/165
2,420,260 A * 5/1947 Myszkowski ..... 15/22.1
4,317,249 A * 3/1982 Benson ..... 15/213
5,709,003 A * 1/1998 Batch ..... 15/106
6,067,684 A * 5/2000 Kweon ..... 15/167.1

OTHER PUBLICATIONS http://www.britannica.com/ebc/article?eu=381225&query=resilient&ct=gen1.*

* cited by examiner

*Primary Examiner*—Robert J. Warden, Sr.
*Assistant Examiner*—S Balsis
(74) *Attorney, Agent, or Firm*—McGuireWoods LLP

(57) ABSTRACT

The present invention relates to a baby bottle brush for washing a nursing bottle. The brush comprises at least one soft and resilient support member, a washing brush, and a cap inserted into an opening portion of the nursing bottle with the upper end of the support member fixed and rotated to the right and to the left by a user. According to the brush, the interior of a nursing bottle is easily and quickly washed.

16 Claims, 11 Drawing Sheets

BABY BOTTLE BRUSH

TECHNICAL FIELD

The present invention relates to a baby bottle brush, and more particularly to a brush for washing a nursing bottle which can wash the inner surface of a nursing bottle uniformly and quickly and can use the nursing bottle sanitarily by integrally attaching a silicon brush to a support member which can be freely unfolded so as to have a shape which is identical with the inner shape of the nursing bottle and then inserting the silicon brush into the interior of the nursing bottle.

BACKGROUND ART

Generally, a nursing bottle is a means for supplying the nutrition which is needed for a growing baby instead of the mother's milk. Since the nursing bottle is used for a baby who has a low immunity, the nursing bottle should be sanitarily used and the nursing bottle should be often washed or sterilized.

Especially, the dregs in the nursing bottle should be clearly removed through the washing or the sterilization to prevent the propagation of germs.

A general washing device includes a knob which can be rotated or fixed, a twisting wire which is positioned between the knob, and a brush portion which is engaged with the twisting wire so as to have an annular shape. A cleaning device is located at the lower end of the brush portion. The cleaning device is made of sponge, nylon or cloth so that it can clean the bottom surface of the nursing bottle. The cleaning device is integrally engaged with the lower end portion of the twisting wire.

According to the above-mentioned structure, the annular brush portion is rotated or move upwardly and downwardly to remove the dregs in the nursing bottle. However, the above-mentioned structure should be watched in the naked eyes of a worker, and thus only certain portions of the nursing bottle are washed. Further, the bottom surface of the nursing bottle cannot be washed cleanly and uniformly.

Namely, the sponge or the cloth washes the bottom surface of the nursing bottle by using the friction with the bottom surface, but a uniform and strong frictional force cannot be transferred to all the bottom surface. Further, since the twisting wire is rotated or moved to the right and to the left to wipe the bottom, its frictional force is low. Thus, the solid dregs can not be removed and the peripheral portions of the inner surface of the nursing bottle can not be washed.

In order to overcome the lack of the frictional force, an excessive force is applied and the washing device is adhered to the bottom surface. In the occasion, the excessive friction scratches the inner surface of the nursing bottle.

Further, the sponge and the cloth are damaged over time. Further, in case the dregs of the content is absorbed when the nursing bottle is washed, the washing of the cleaning device is difficult and it is not sanitary.

Namely, due to the weak durability, the reliability of the device is low, and the device can be deformed by the often washing and the sterilization. Further, some portions of the cleaning device can be attached to the nursing bottle, which can be eaten by a baby.

In order to settle the above-mentioned problems, a plate type silicon is molded so as to have a symmetrical shape. The cleaning device includes a washing hair which is plurally formed on both surface of the cleaning device. The lower end of the twisting wire is inserted into the central portion of the silicon.

According to the cleaning device, a pair of silicon cleaning device is widened so as to have a linear shape as the cleaning device contacts with the bottom surface. Therefore, in order to maintain the widened state, a constant pressure should press the cleaning device. Further, when the washing is completed, the restoring force of the silicon should be restored by the restoring force of the silicon, but the washing hair can be an intervening cause.

The inner peripheral wall can guarantee the durability since the conventional brush portion is used. Further, the cleaning device cannot have a washing means which corresponds to the shape of the nursing shape. Further, the washing time is two long.

Further, since the brush portion is inserted with a cap opened, too much consideration is needed to wash the nursing bottle.

DISCLOSURE OF INVENTION

Therefore, the present invention replaces the material of a support member to which a silicon washing brush of an excellent durability which a soft and resilient material and increases the number of installing parts. In the normal state, the support member remains concentrated. In the state in which a nursing bottle is inserted, the support members are unfolded so as to have a shape identical to the inner peripheral surface of the nursing bottle. The structure of the washing brush is simplified so as to rotate through an opening cap of the nursing bottle. The time for one rotation is shortened, the interior of the nursing bottle is easily washed uniformly. Therefore, the reliability of the washing brush is guaranteed.

In order to achieve the above-mentioned objects, the present invention includes a soft and resilient support member which is obtained by machining the inside thickness of the inside so as to be unfolded with a shape identical to the shape of the inner surface of the nursing bottle, a silicon washing brush which is attached to the outer surface and the lower end portion of the support member and is integrally shrunk according to the resilient operation of the support member, and a cap which is inserted into an opening of the nursing bottle with the upper portions of the support members fixed and which can be easily rotated by a user.

On the other hand, the washing brush according to the present invention provides a washing brush of a silicon material so that the inner peripheral wall and the bottom surface can be simultaneously washed. Then, the washing brush is engaged with a circular rotating member inserted in the central portion of the nursing cap. As a knob attached to the rotating member is rotated, the washing brush is rotated and uniformly washes from the neck portion of the nursing bottle to the inner peripheral wall and the bottom surface. Therefore, the washing is promptly accomplished.

In order to achieve the above-mentioned object, the inner peripheral wall and the bottom surface has a curved band shape. A plurality of washing hairs are formed on the outer surface of the washing brush. A washing brush of a silicon in which at least one inserting boss is protruded, a support member having an insertion recess at a proper position so that an insertion boss is inserted so as to have a shape corresponding to the washing brush, a circular rotating member which is rotatably inserted into a central portion of a opening cap of the nursing bottle so that it can be rotated freely, and a knob which is integrally engaged with the upper end portion of the circular rotating member to freely move the circular rotating member.

BRIEF DESCRIPTION OF DRAWINGS

This invention will be better understood and its various objects and advantages will be more fully appreciated from the following description taken in conjunction with the accompanying drawings, in which.

BEST MODE FOR CARRYING OUT THE INVENTION

A washing brush according to the present invention is shown in FIGS. 1 to 13. A washing brush according to a preferred embodiment of the present invention is shown in FIGS. 1 to 7, and a washing brush according to another preferred embodiment of the present invention is shown in FIGS. 8 to 13.

Figure 1:
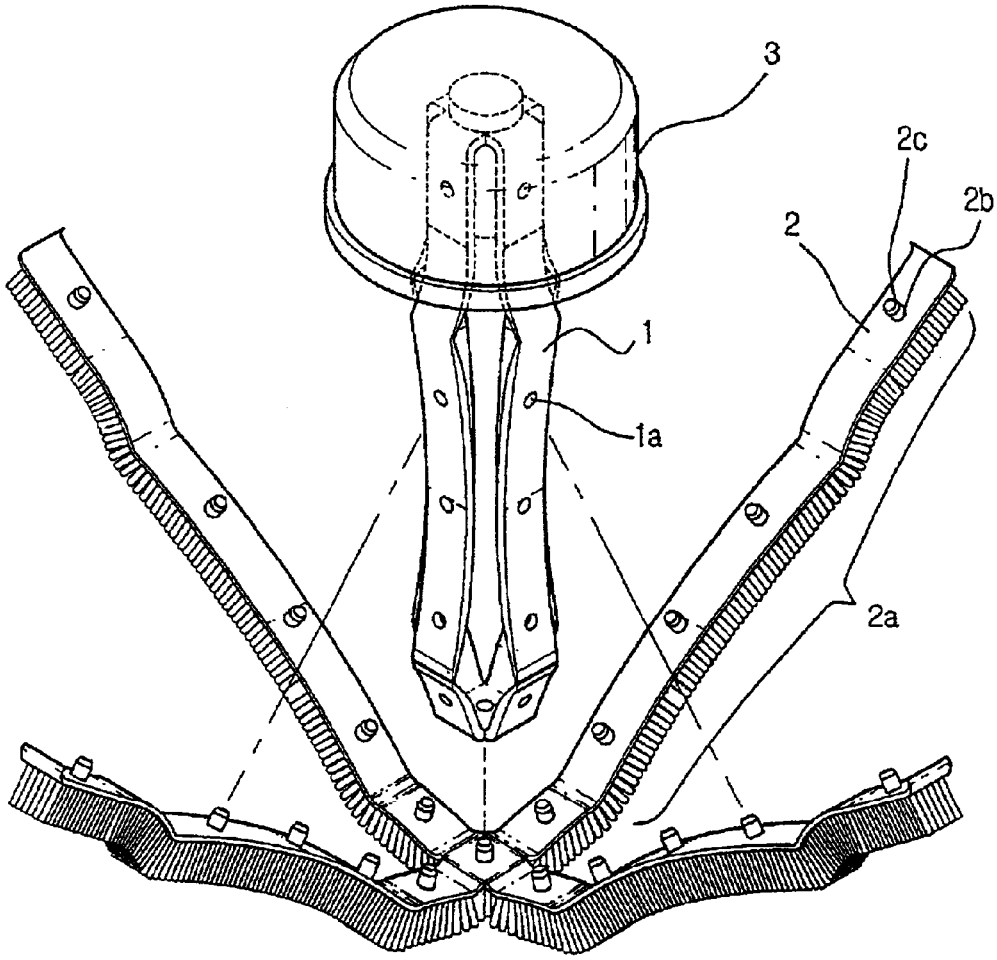
FIG. 1 is a perspective view for showing a washing brush of the present invention before it is assembled.
Figure 2:
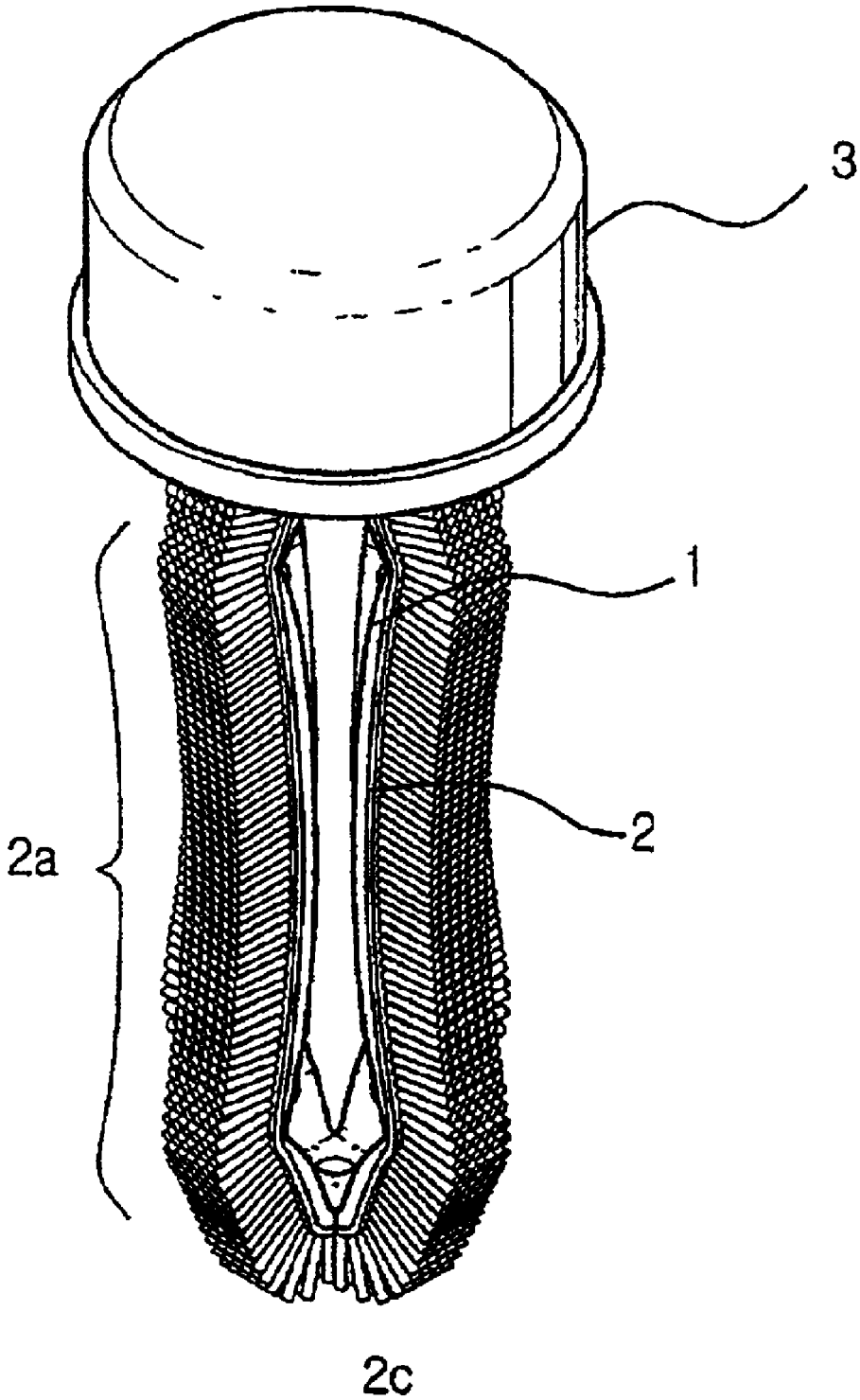
FIG. 2 is a perspective view showing the state in which the washing brush shown in FIG. 1 is assembled.
Figure 3:
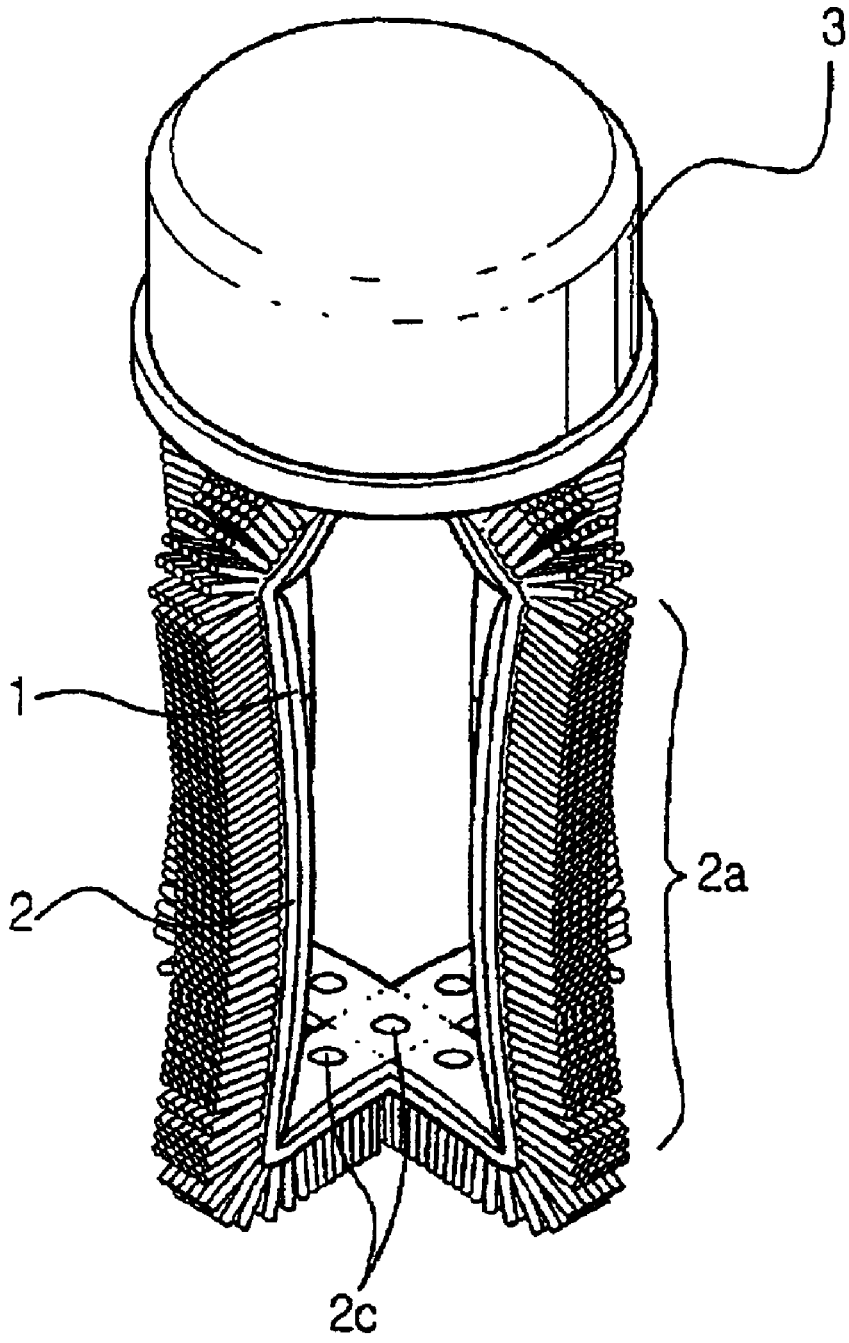
FIG. 3 is a perspective view for showing the state in which the washing brush shown in FIG. 1 is assembled with the lower end of the support member pressed.

FIG. 1 is a perspective view for showing the washing brush according to the present invention, and FIGS. 2 and 3 show the unfolded state of the washing brush. Referring to FIG. 2, the washing brush according to the present invention includes a support member 1 which is made of a soft and resilient material so as to be unfolded to have a shape identical to the shape of the inner peripheral surface of a nursing bottle 10. The thickness of a portion of a support member 1 which is curved according to the shape of the nursing bottle 10 is thinner than the rest portions. Therefore, if the lower surface is lifted, the thin portion is easily curved, and so the washing brush is unfolded by the reduced height according to the shape of the nursing bottle 10. If the pressure of the lower surface is released, the support member is extended so as to have the initial state.

The support member is plurally provided, and is unfolded so as to be located at the portion of the interior of the nursing bottle 10. At least one insertion recess 1*a* is formed at a proper position of the outer surface.

The outer surface of the support member 1 is made of a silicon which is the material of a nipple. A silicon washing brush 2 is attached to the support member 1. The washing hair 2*a* which is softly curved is integrally formed. An insertion boss 2*b* in which a catching portion 2*c* is formed is integrally protruded on the inner surface thereof. The catching portion is inserted into the insertion recess 1*a* of the support member 1 so as to be fixed to the catching portion 2*c*. The insertion boss 2*b* is expanded through the heating to be integrally formed with the support member 1.

According to the resilient operation of the support member 1, the washing brush 2 is flexible. When the washing brush is unfolded, the washing hair 2*a* is adhered to the inner peripheral surface of the nursing bottle 10. An opening cap 3 to which the upper end of the support member 1 is fixed is provided, and is inserted into the opening of the nursing bottle. The washing brush 2 is rotated through the rotation by a user.

Figure 4:
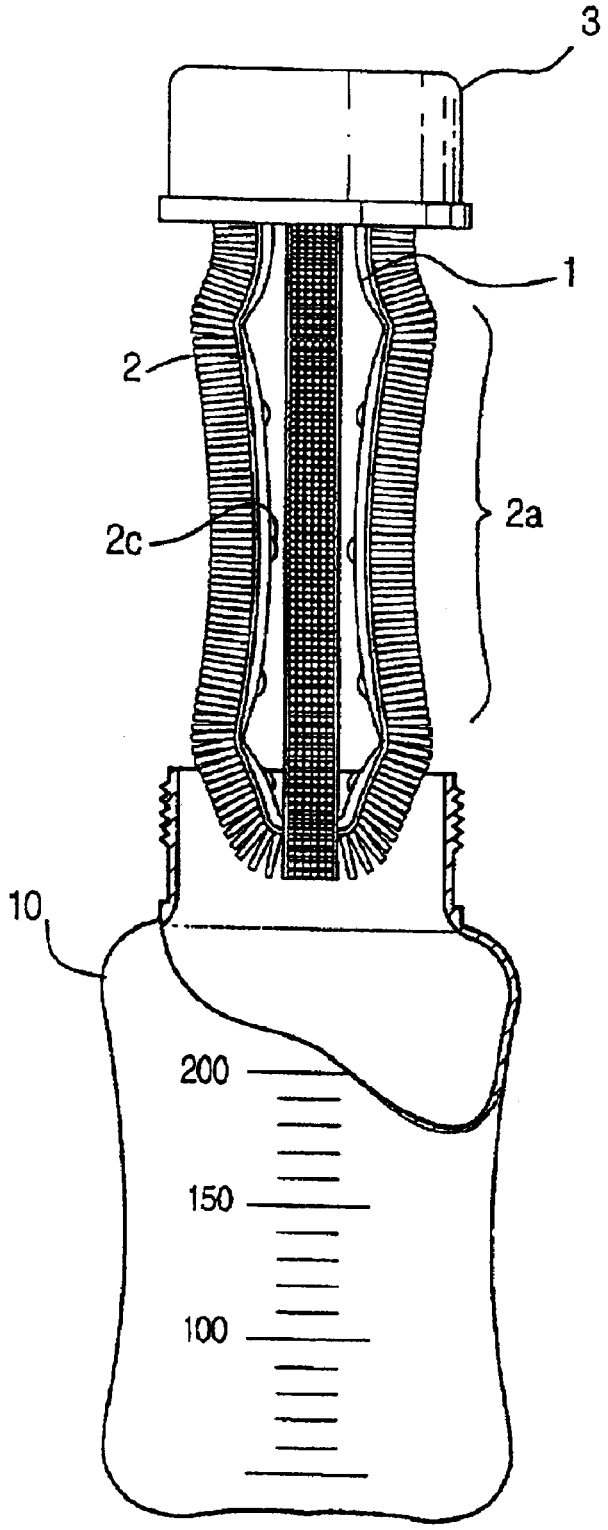
FIG. 4 is a view for showing the state in which the washing brush according to the present invention is introduced into a nursing bottle.
Figure 5:
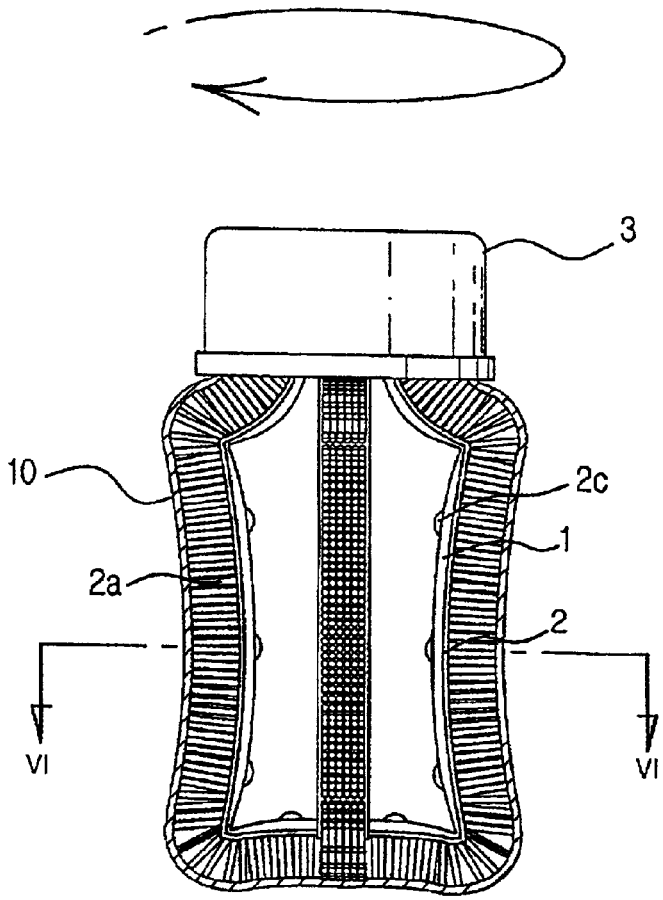
FIG. 5 is a view for showing the state in which the washing hairs is unfolded to be adhered to the inner surface of the nursing bottle.
Figure 6:
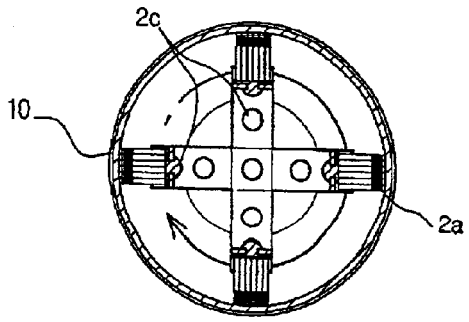
FIG. 6 is a cross-sectional view taken along line VI—VI shown in FIG. 5.
Figure 7:
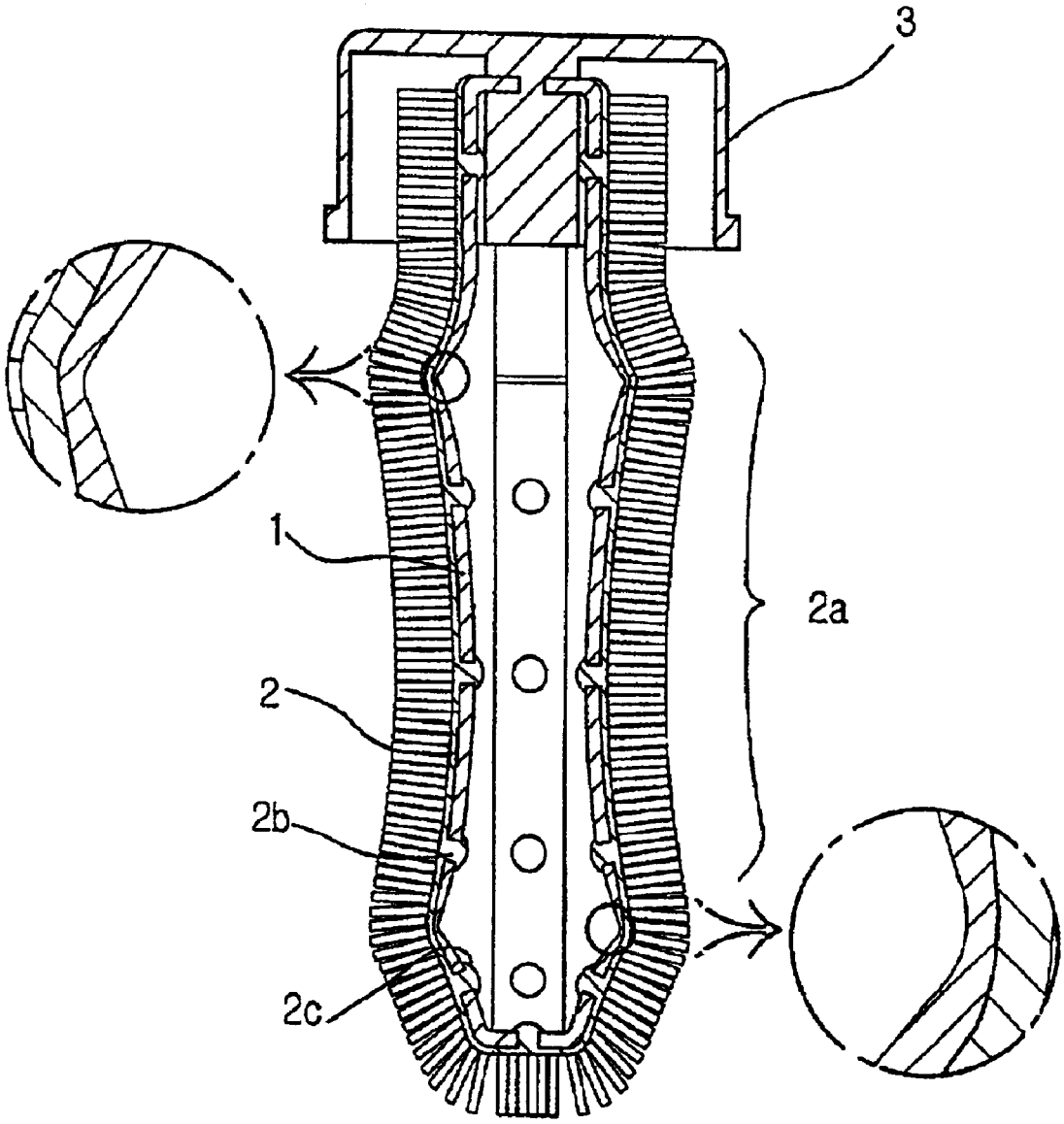
FIG. 7 is a cross-sectional view of the washing brush shown in FIG. 2 which is taken vertically.
Figure 8:
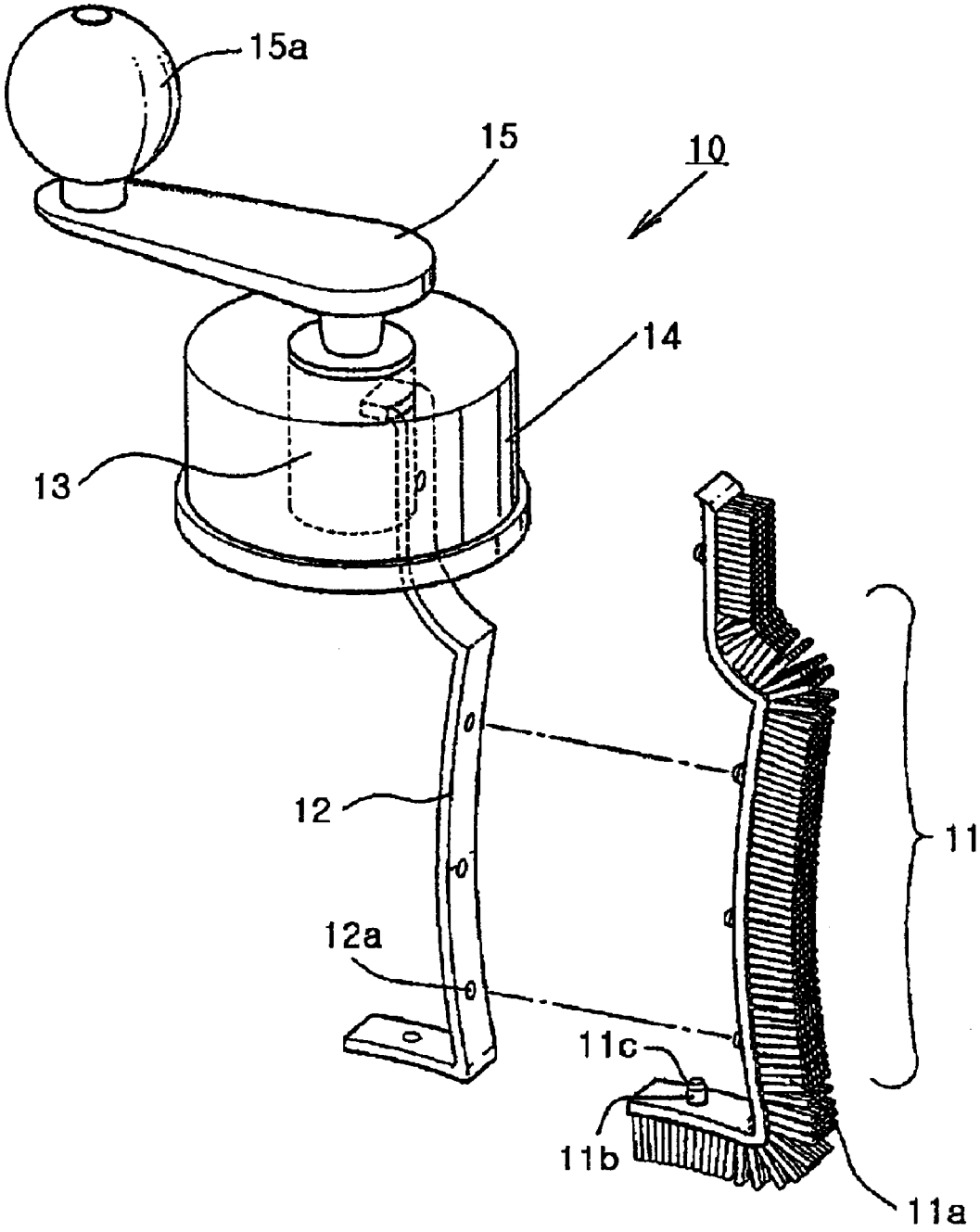
FIG. 8 is a perspective view for showing the state before a washing brush according to another preferred embodiment of the present invention is assembled.
Figure 9:
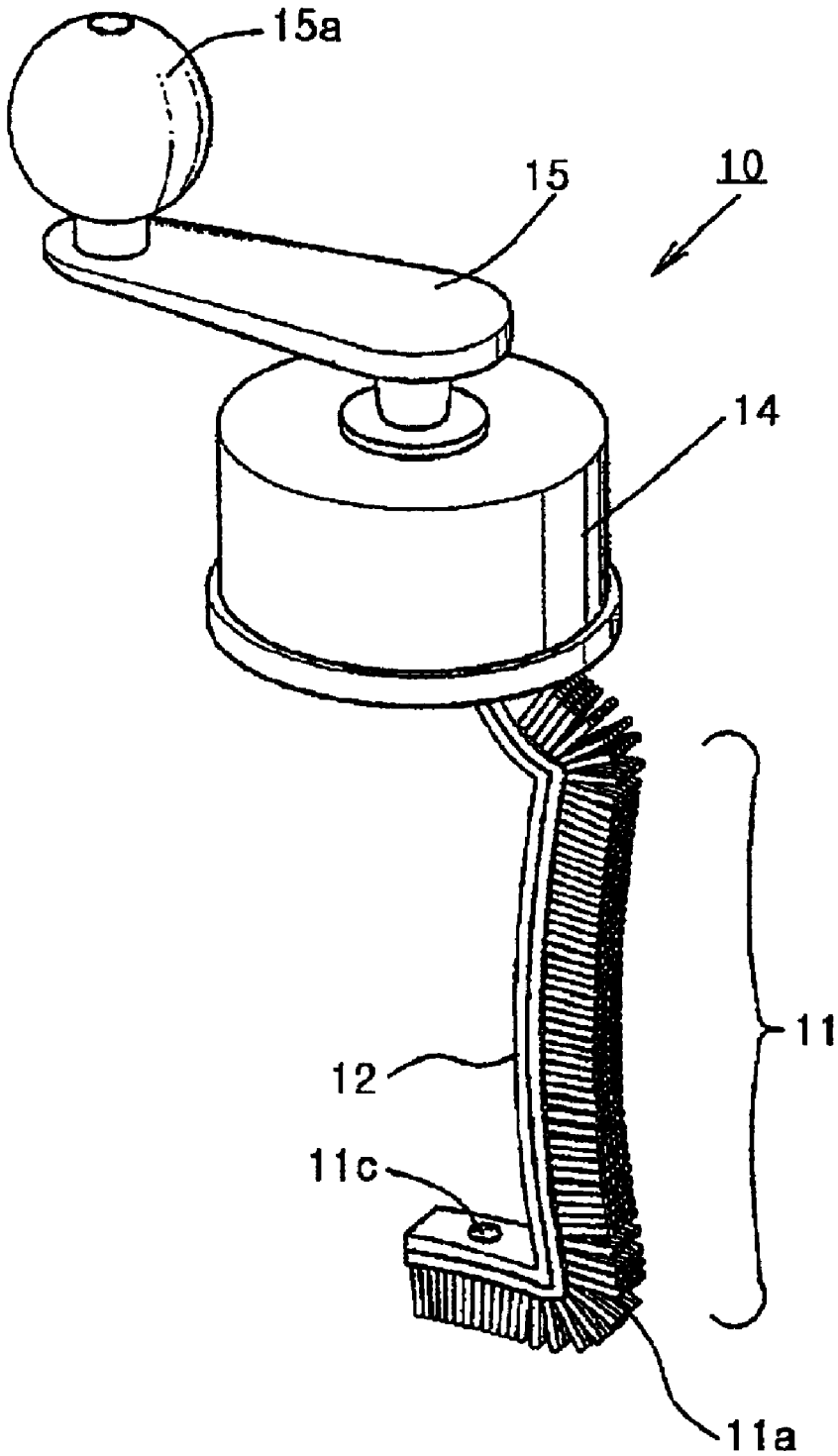
FIG. 9 is a perspective view for showing the state in which the washing brush shown in FIG. 8 is assembled.
Figure 10:
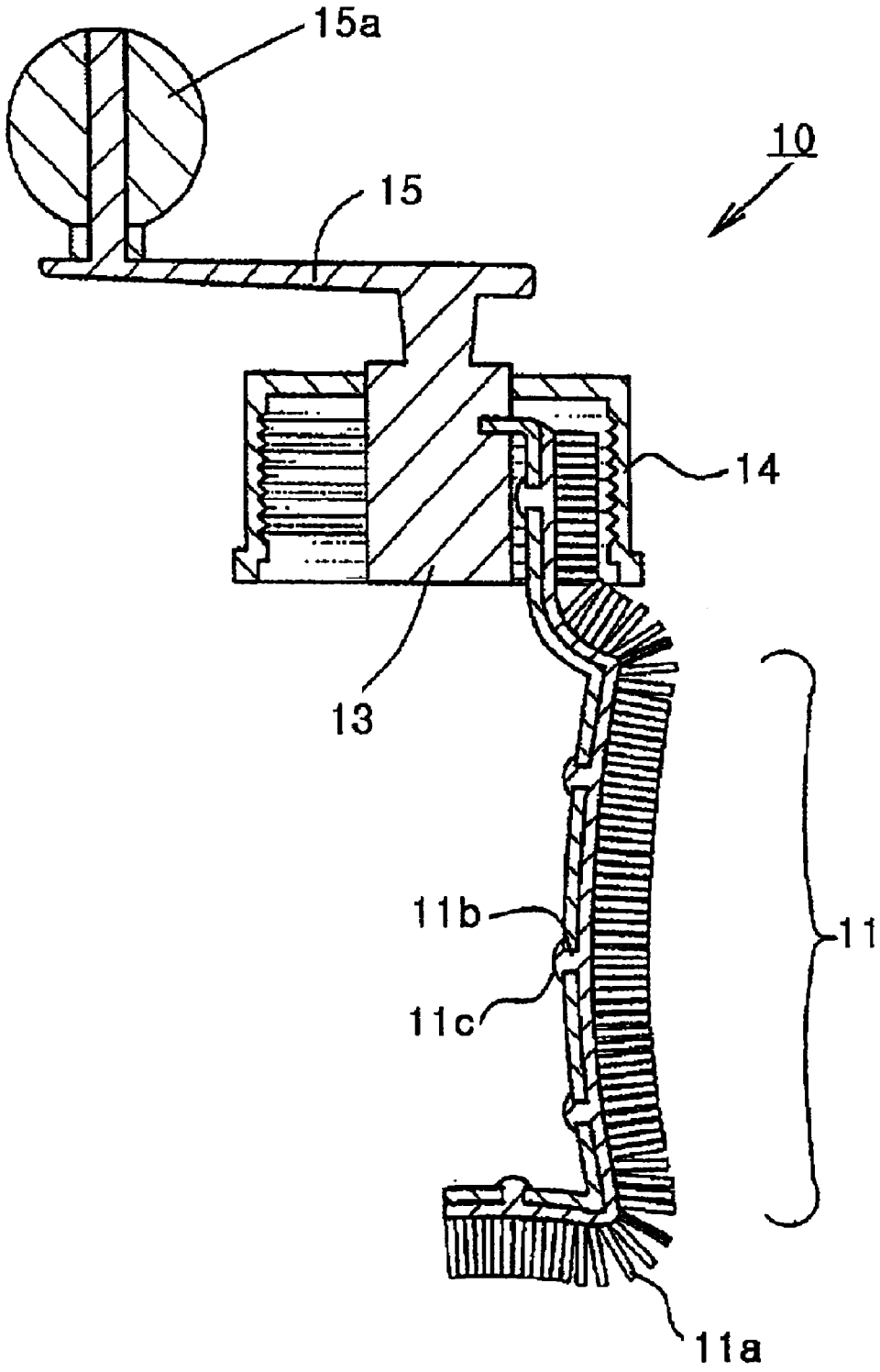
FIG. 10 is a cross-sectional view for showing the washing brush shown in FIG. 9 which is taken vertically.

FIG. 4 shows the state in which the washing brush is inserted into the nursing bottle. FIG. 5 shows the state in which the washing brush is introduced into the nursing bottle and then is unfolded. FIG. 6 is a cross-sectional view for showing the washing brush which is unfolded.

In order to wash the nursing bottle 10 by using the washing brush according to the present invention, the cap of the nursing bottle is opened and the washing brush according to the present invention should be inserted into the nursing bottle 10.

In the state in which the washing brush 2 is adhered to the bottom of the nursing bottle 10, if the inlet of the nursing bottle 10 is closed by pressing an opening cap 3, the support member 1 and the washing brush 2 is unfolded so as to have the shape of the inner peripheral surface of the nursing bottle 10 so that the washing hair 2*a* is adhered to the inner wall of the nursing bottle 10.

The unfolded degree is calculated by the shape of the nursing bottle, and so the generation of the error is minimized.

Therefore, by rotating the opening cap 3 properly, a plurality of washing brushes 2 is rotated in the initial position to uniformly wash the inner surface of the nursing bottle 10.

The washing brush according to the present invention uses the silicon which has an excellent durability and can be easily washed as the washing brush of the nursing bottle. Therefore, the damage of the washing brush and the sanitary problem of the washing brush is settled. Further, by washing the nursing bottle with a uniform frictional force, the washing effect is increased. Further, by the cushion operation of the resilient washing hair, the damage of the nursing bottle is prevented.

On the other hand, as shown in FIGS. 8 to 13, the washing brush 10 according to another preferred embodiment of the present invention comprises a washing brush 11 which is curved and has a narrow width of a band shape and a length which can be opposite of the bottom surface of the nursing bottle 20, a support member 12 which firmly supports the washing brush 11, a circular rotating member 13 to which the support member 12 is fixed, and a knob 15 which is integrally connected to the nursing bottle cap 14 and the circular rotating member 13.

The washing brush 11 is made of a silicon which is the material of the nipple. The washing brush 11 is integrally formed so as to be extended along the central portion of the inner peripheral wall and the bottom surface. A washing hair 11*a* is integrally formed on the outer surface of the washing brush.

In the preferred embodiment, the length of the washing hair 11*a* is 8 mm considering the nursing bottle 20, but is not limited to the length.

An insertion boss 11*b* in which a catching portion 11*c* is formed is integrally protruded on the inner surface of the washing brush 11.

The support member 12 is made of a synthetic resin. The support member 12 maintains the shape and the position of the washing brush 11. An insertion boss 11*b* is inserted into the support member 12. By fixing with the catching portion 11*c* and enlarging the catching portion 11*c* itself, the insertion recess 12*a* is integrally formed with the support member 12.

A circular rotating member 13 is formed by bending the extended upper end of the support member 12. The circular rotating member 13 is engaged with the nursing bottle 20. The circular rotating member is rotatably inserted so as to rotate in the central portion of a second nursing bottle cap 14.

In order to compulsorily rotate the circular rotating member 13, a knob 15 having a knob portion 15*a* of a ball shape is integrally engaged with the upper end portion of the circular rotating member 13.

Figure 11:
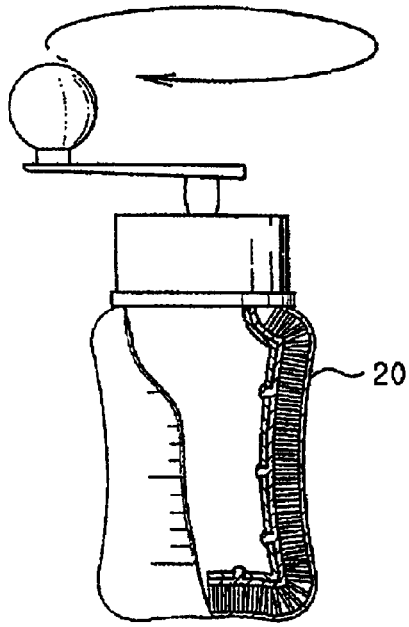
FIG. 11 is a partial cross-sectional view for showing the state in which the washing brush shown in FIG. 9 is introduced into the nursing bottle.

FIG. 11 shows the initial state in which the present invention is inserted into the nursing bottle. After the original nursing bottle cap is opened, the nursing bottle cap according to the present invention is engaged. The washing brush 11 engaged with the support member 12 is located with the inner surface of the nursing bottle 20, and the washing hair 11*a* is adhered to the inner peripheral wall of the nursing bottle 20 and to the neck portion of the nursing bottle 20.

The waiting state is possible due to the shapes of the support member 12 and the washing brush 11 which is curved with the support member 12 and the washing brush 11 inclined from the central portion of the nursing bottle cap 14 to the inner wall of the nursing bottle 20. The washing hair 11*a* should be adhered to the line from the neck portion to the central portion of the bottom surface.

Figure 12:
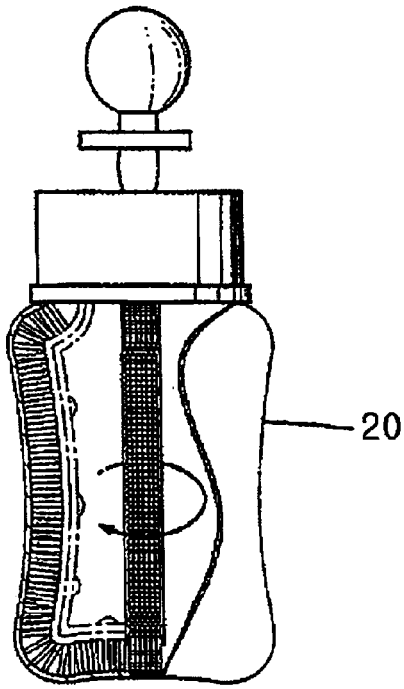
FIG. 12 is a partial cross-sectional view for showing the state in which the washing brush is rotated.
Figure 13:
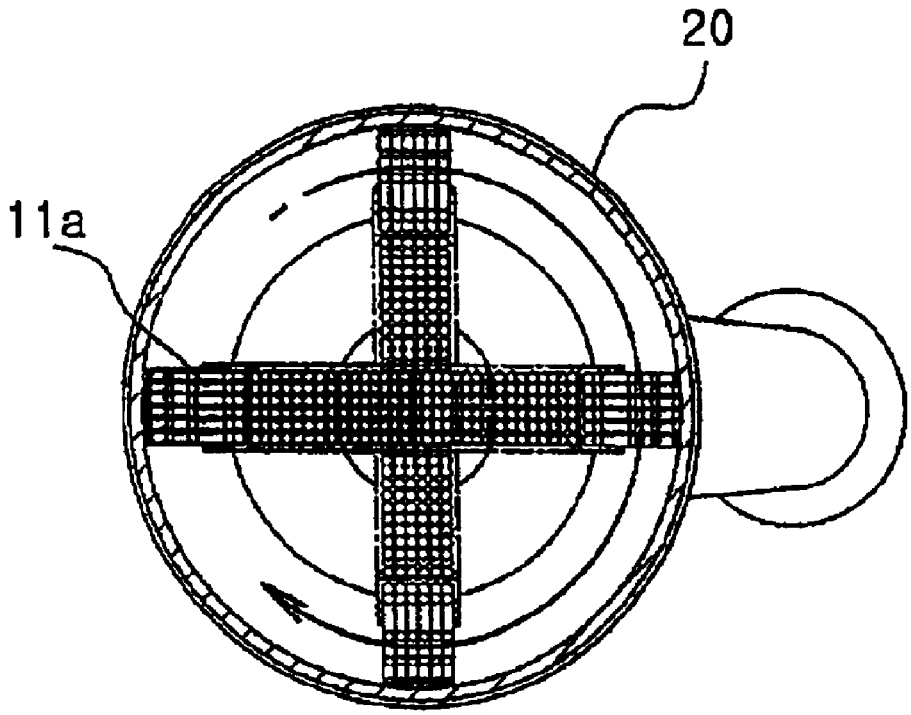
FIG. 13 is a view for showing the washing brush shown in FIG. 9 is inserted into the nursing bottle.

If the knob 15 is rotated by a user as shown in FIG. 12, the detergent of the nursing bottle 20 or the washing hair 11*a* of the washing brush 11 is supplied to the inner peripheral wall of the nursing bottle along the circular rotating member which is rotated in the reference of the nursing bottle cap 4, and all the inner surfaces of the nursing bottle is uniformly wiped.

The washing brush and the support member can be changed by the simple insertion engagement method.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. A brush for washing a nursing bottle, which comprises:

at least one resilient support member which is unfolded so as to have a shape substantially identical with a shape of an inner peripheral surface of a nursing bottle, an inner side of a curved portion of the resilient support member having a thinner width than other portions of the resilient support member;

a washing brush attached to an outer surface and a lower end portion of the resilient support member and integrally expanded and contracted according to operation of the resilient support member; and a cap inserted into an opening portion of the nursing bottle having an upper end of the resilient support member adapted to be rotatable, wherein at least one hole is formed at a predetermined position in the resilient support member, and an insertion boss in which a catching portion having a diameter larger than a diameter of a hole is formed at a position corresponding to the hole of the resilient support member and formed so that the washing brush is detachably attached on the support member.

2. A brush according to claim 1, wherein a circular rotating member is installed in a cap and inserted in to an opening of a nursing bottle, and upper portions of the support members are fixed to the circular rotating member, and a knob bent vertically with respect to the direction of a rotary shaft protrudes from an upper portion of the cap.

3. A brush according to claim 1, wherein the washing brush includes silicon.

4. A brush for washing a bottle, comprising:

at least one expandable resilient support member having a lower portion and curved side portion, wherein the curved side portion has a shape which substantially conforms to a shape of an interior surface of the bottle when the support member is in an expanded position and a washing brush is directly attached to the resilient support member; and wherein the washing brush is attached to the resilient support member with an insertion boss and the washing brush substantially conforms to a shape of the resilient support member.

5. The brush for washing a bottle of claim 4, wherein the insertion boss includes a catching portion that substantially prevents the washing brush from being disconnected from a hole formed in the resilient support member.

6. The brush for washing a bottle of claim 4, further comprising a cap attached to an end portion of the resilient support member.

7. The brush for washing a bottle of claim 6, wherein the resilient support member is attached to a rotating member attached to the cap that permits rotation of the resilient support member.

8. The brush for washing a bottle of claim 7, wherein the rotating member is attached to a second rotating member arranged on an upper portion of the cap.

9. The brush for washing a bottle of claim 8, wherein the second rotating member is a knob comprising a knob portion.

10. The brush for washing a bottle of claim 4, wherein the at least one resilient support member includes two or more resilient support members.

11. The brush for washing a bottle of claim 10, wherein the lower portion of the resilient support members are attached at an end portion.

12. The brush for washing a bottle of claim 4, wherein the at least one resilient support member includes four resilient support members.

13. The brush for washing a bottle of claim 12, wherein the four resilient support members are arranged to be at a substantially equal distance from each other.

14. The brush for washing a bottle of claim 4, wherein the resilient support member comprises silicon.

15. The brush for washing a bottle of claim 4, wherein the washing brush comprises silicon.

16. The brush for washing a bottle of claim 4, wherein the brush is sized and adapted for a nursing bottle.

* * * * *